United States Patent [19]

Harvey

[11] 4,137,635

[45] Feb. 6, 1979

[54] STANDARD PARALLEL RULE WITH PERSPECTIVE DRAWING DEVICE

[76] Inventor: Douglas P. Harvey, 1654 Marshall No. 1, Houston, Tex. 77006

[21] Appl. No.: 829,952

[22] Filed: Sep. 1, 1977

[51] Int. Cl.[2] ..... B43L 13/14

[52] U.S. Cl. ..... 33/77

[58] Field of Search ..... 33/77

[56] References Cited

U.S. PATENT DOCUMENTS

| | | | |
|---|---|---|---|
| 1,964,198 | 6/1934 | Edison | 33/77 |
| 2,184,718 | 12/1939 | Lopez | 33/77 |
| 2,590,252 | 3/1952 | Horst et al. | 33/77 |
| 3,783,519 | 1/1974 | Sartori | 33/77 |

FOREIGN PATENT DOCUMENTS

| | | | |
|---|---|---|---|
| 426987 | 4/1935 | United Kingdom | 33/77 |
| 162666 | 5/1964 | U.S.S.R. | 33/77 |

*Primary Examiner*—Charles E. Phillips
*Attorney, Agent, or Firm*—Lee & Smith

[57] ABSTRACT

A standard draftsman's parallel bar or rule is adapted to draw perspective lines by an auxiliary cable and differential pulley system which when detached allows conventional parallel operation.

6 Claims, 5 Drawing Figures fig.1.
(EXISTING DEVICE)
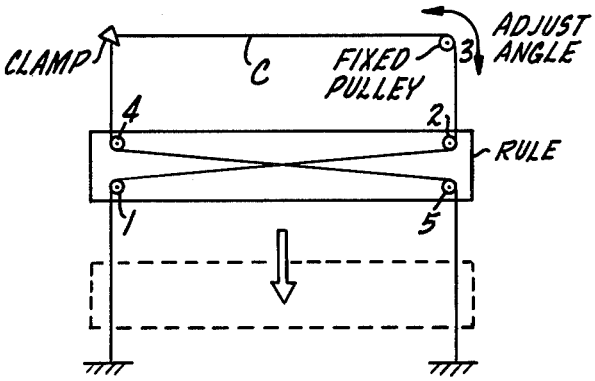
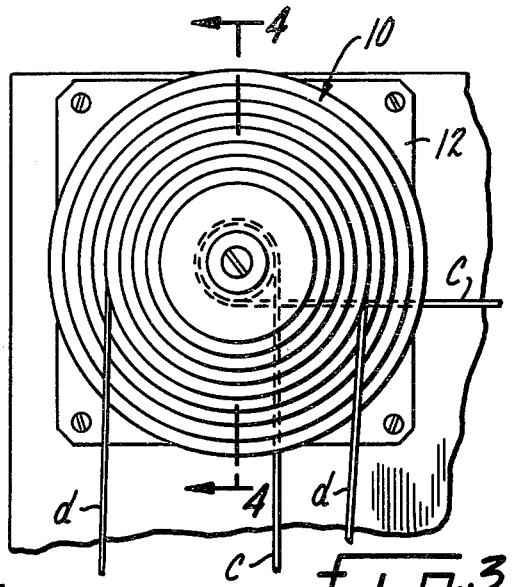
fig.3.
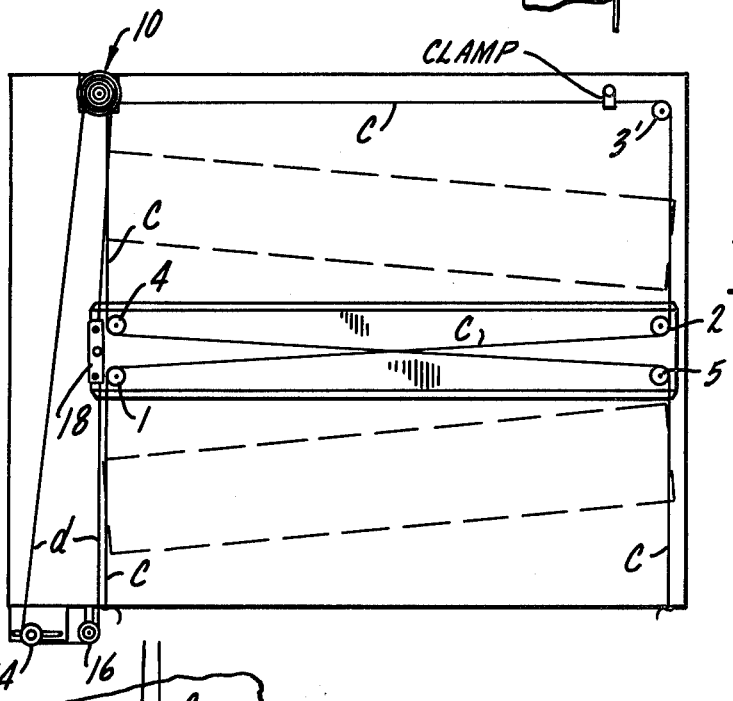
fig.2.
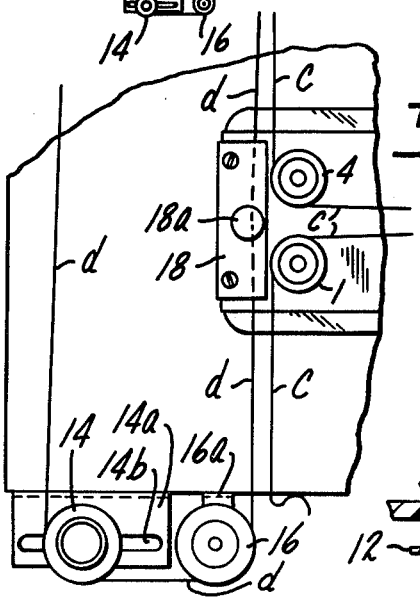
fig.5.
fig.4.
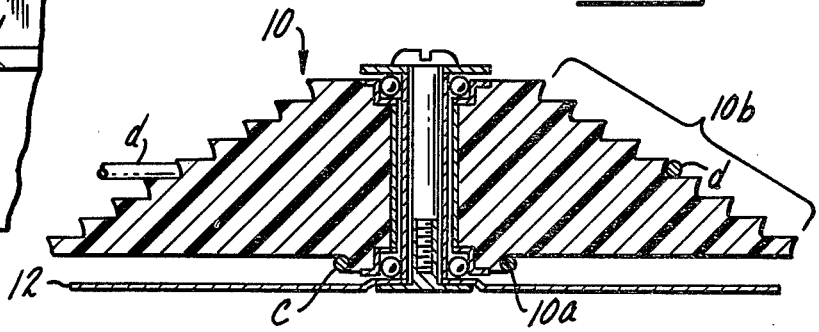

STANDARD PARALLEL RULE WITH PERSPECTIVE DRAWING DEVICE

BACKGROUND OF THE INVENTION

The invention relates generally to the field of drafting equipment and particularly to architectural rendering equipment and the like.

All architects who do any drawing have a drafting table with a standard device called a parallel bar or parallel rule. Because of a crisscrossed cable and pulley arrangement, the parallel rule remains parallel when moved up or down to allow the drawing of horizontal parallel lines, and with the addition of a triangle rule layed firmly against the edge of the parallel rule, the drawing of vertical lines. Thus the parallel rule is one of the most elementary drafting tools. Conventional parallel rule assemblies have been marketed for many years, for example, by Mayline Corporation of Sheboygan, Wis.

In most perspective drawings, vertical edges remain as true verticals; therefore, these edges can be constructed using a conventional parallel rule. The construction of nominally horizontal lines is an entirely different matter, because they must radiate from a distant point which may be 10 feet or more away and thus they will never be parallel. As the location of these points are specified by a geometrical method, the resulting radius lines must diverge in a predictable fashion, creating a controllable set of angles; from these angles comes the illusion of horizontal edges of planes tapering into the distance.

Large architectural renderings frequently involve the use of cumbersome, inconvenient or expensive equipment to draw perspective lines having vanishing points on the order of 15 feet. Incredible as it may seem to laymen, the conventional practice has been to use a 15 foot long pivoted ruler for doing 15 foot perspective drawings. The alternatives are the purchase of expensive automatic perspective drawing machinery such as that currently offered for example by Dietzgen Corporation of Chicago, Ill., or the use of a transparent sheet having preruled perspective lines of the required vanishing point placed on a drawing board illuminated from behind, necessitating the use of tracing paper for the drawing and stocking various sizes of preruled sheets. Consequently, many architects have chosen to routinely send out large perspective drawings to professional rendering companies.

SUMMARY OF THE INVENTION

The solution to the problem of how to bring a convenient, versatile, low-cost perspective drawing capability to the average architect or draftsman lies in adapting the standard parallel rule already universally employed by architects, to allow the parallel rule itself to draw perspective lines using an auxiliary "add-on" device which, when detached, does not interfere with the use of the rule for parallel line drawings. This object is accomplished in an extraordinarily simple and direct fashion. The standard draftman's parallel rule (FIG. 1) is modified by replacing the clamp and fixed pulley located at the upper left hand corner of the assembly with a compound differential pulley carrying an endless auxiliary cable secured to one end of the rule and by freeing the fixed pulley in the upper right hand corner for rotation. The clamp is relocated to a convenient place at the top of the standard assembly so that the rule can be used for parallel lines by fixing the clamp on the standard cord and releasing the auxiliary cable from the rule.

BRIEF DESCRIPTION OF THE DRAWING

FIG. 1 is a schematic diagram of a standard draftsman's parallel rule with a second position of the rule indicated in dashed lines.

FIG. 2 is a plan view of a standard draftsman's parallel rule assembly with an auxiliary perspective drawing device according to the invention, with other positions in dashed lines.

FIG. 3 is a detailed plan view of the differential compound pulley of the drawing device of FIG. 2.

FIG. 4 is a sectional view of the compound pulley taken along lines 4—4 of FIG. 3.

FIG. 5 is a detailed view of the idler pulleys and the rule clamp for the auxiliary cable of the drawing device of FIG. 2.

DESCRIPTION OF THE PREFERRED EMBODIMENT

The following disclosure is offered for public dissemination in return for the grant of a patent. It is detailed to ensure adequacy and aid understanding; however, the scope of the invention is defined by the claims appended to the end of this description and all variations, substitutions and modifications which are embraced by the principle of the invention as claimed.

FIG. 1 illustrates the arrangement of the existing standard draftman's or architect's parallel bar or parallel rule. It comprises a single length of cord c fixed at its ends to the lower edge of the drafting table and arranged about a series of pulleys in the order shown in FIG. 1 in the configuration of a "figure 8" open at the bottom. The standard rule itself requires a pair of pulleys at either end. The cord c proceeds from the bottom left-hand corner of the drafting table, as viewed in the drawing, around the lower left-hand pulley No. 1 rotatably mounted on the rule and crosses over to the upper right-hand pulley No. 2 also rotatably mounted on the rule. Then the cord c passes around a pulley No. 3 fixed to the drafting table at the upper right-hand corner and then crosses horizontally to the left-hand upper corner under a clamp affixed to the table and then downwardly around upper left-hand pulley No. 4 rotatably mounted on the rule and crossing back over itself to the lower pulley No. 5 on the right of the rule and ending at the lower right-hand corner of the drafting table.

The rule is oriented initially as desired and then the cord is normally permanently clamped and not readjusted by the draftsman unless it becomes necessary. With the cord clamped, the fixed pulley in the upper right-hand corner serves only as a post about which the cord is looped. Because of the rotatable pulleys Nos. 1, 2, 4 and 5 mounted on the rule itself, however, the rule is free to travel upward or downward. Because of the fixed geometry, the rule remains parallel since it is unable to rotate about any axis due to the fixed cord lengths established by the clamp.

The modification to the parallel rule shown in FIG. 2 permits it to duplicate the action of the conventional pivoted straight edge of any required length, and will still allow the rule's use in a conventional manner with only simple adjustments. FIG. 2 shows a conventional parallel rule carrying the four rotatable pulleys 1, 2, 4 and 5 with the conventional length of cord c having its lower ends affixed to the bottom edge of the drafting table. The fixed pulley 3 of FIG. 1 is replaced in FIG. 2 by a rotatable pulley 3'. The cord clamp of FIG. 1 is relocated to an arbitrary position along the top horizontal run of the cord c.

At the upper left-hand corner, the conventional cord c is wrapped around a differential compound pulley 10 rotatably mounted on a mounting plate 12 affixed to the drafting board as shown in FIGS. 3 and 4. The conventional cord c is received in a circular pulley groove 10*a* on the underside of the pulley 10. The conventional cord c is wrapped around 270° of the circular groove 10*a* for increased friction. The upper exposed cone-shaped surface of the pulley 10 carries a stepped series of circular pulley grooves 10*b* becoming gradually smaller toward the top. An endless auxiliary cable d is looped around a selected one of the stepped pulley grooves 10*b*, contacting about 180° of the groove.

A pair of idler pulleys 14 and 16 are mounted to the lower left-hand edge of the drafting table by suitable L-shaped angle brackets 14*a* and 16*a* respectively. Bracket 14*a* has a slot extending parallel to the edge of the drafting table allowing adjustment of the transverse position of the idler pulley 14 by means of a knurled tightening screw. Idler pulley 16 has a fixed location in line with the end of the rule. The auxiliary cable d is looped around the idler pulleys 14 and 16 and the portion of the cable d which crosses the end of the rule is placed under a clamp 18 with a knurled screw release 18*a* by which the cable d can be secured to the left-hand end of the rule. Any slack remaining in the cable d is taken up by relocating the idler pulley 14 towards the left in slot 14*b*.

To do perspective line drawing, the regular clamp for cord c is released and auxiliary cable d is attached to the rule by clamp 18. When the parallel rule is moved upward, auxiliary cable d drives the compound pulley 10 counterclockwise, which in turn drives the conventional cord c clockwise as viewed at the top of the drafting table. As the conventional cord c moves to the right between the pulleys 10 and 3', the alignment of the rule changes so that it moves up differentially more on its left than it does on its right. When the rule moves down, a reverse sequence of motions occurs. Lines drawn from a parallel rule which moves in this manner converge to a center of radius on the right. Its distance is determined by the size ratio of the circular pulley grooves engaged by the auxiliary cable d and the conventional cord c. When the ratio of the diameter of the circular pulley groove engaged by the auxiliary cable d to the ratio of the pulley groove engaged by the conventional cord c is 2:1, the radius of arc established for the rule is twice the length of the rule; when the pulley ratio is 3:1, the radius is equal to three times the length of the parallel rule, and so on.

If the auxiliary cable d is reversed on the pulley 10, that is, twisted 180° (as is the conventional cord c), the upward motion of the rule drives the pulley clockwise. The result is an identical arc motion, but the center of radius or vanishing point is on the other side of the drafting table.

In all cases the distance to the center of radius is measured from the point where the auxiliary cable d is fastened to the parallel bar. When the device is attached on the bar's left-hand side, as shown in FIG. 1, the bar and its working region lie beyond any radius measured to the left and within any radius to the right.

To alter the center of radius, release the adjustable idler pulley 14 and move the auxiliary cable d to whichever circular pulley groove 10*b* furnishes the desired ratio. Then reset the idler pulley 14 so as to remove the slack and ensure precise motion. Additional slack may be removed by giving the auxiliary cable d an extra turn around any one of the pulleys which it engages.

To do parallel line drawing, release the auxiliary clamp 18, align the parallel rule and fasten the standard clamp at the top of the table for the cord c.

Many variations of the above described device will naturally occur to those skilled in the art; for example, instead of wrapping the conventional cord c around the groove 10*b* in the reverse fashion, it may be of interest to use an additional pulley of larger diameter compounded on a gear to engage a similar gear on the pulley which carries the auxiliary cable d thus reversing the motion between the two pulleys. The preferred embodiment is simpler, however.

The above described invention thus permits conversion of a standard parallel rule to a perspective line drawing device with the addition of a clamp on the end of the parallel rule, a compound differential pulley and an idler pulley system, all easily and quickly installed.

I claim:

1. Drafting apparatus of the type comprising a drawing board and a parallel rule slidably resting on the drawing board and having a pair of pulleys rotatably mounted at either end of the rule and a cord having its ends fixed to the drawing board below the respective ends of the rule with the cord extending between the pulleys in a criss-cross manner, wherein and in combination therewith the improvement comprises:

a first idler pulley assembly rotatably mounted to the drawing board above one end of the rule, the cord extending around said idler pulley;

primary and secondary pulleys rotatably mounted to the drawing board above the other end of the rule, the cord extending tautly around said secondary pulley;

drive means for causing said secondary pulley to rotate when said primary pulley rotates;

a second idler pulley rotatably mounted to the drawing board below said other end of the rule;

an auxiliary cable tautly engaging said primary pulley and said second idler pulley;

means for releasably attaching said auxiliary cable to said other end of the rule; and means for releasably clamping the cord to the drawing board;

whereby when said auxiliary cable is attached to the rule and the cord is released, the rule moves up and down in an arc centered at a predetermined vanishing point, and when said auxiliary cable is released and the cord is clamped, the rule moves up and down without changing orientation so that parallel lines can be drawn.

2. The apparatus of claim 1 wherein said drive means includes said secondary pulley and said primary pulley being coaxially secured for rotation together.

3. The apparatus of claim 1, wherein said drive means includes said primary pulley being coaxially secured on top of said secondary pulley for rotation together.

4. The apparatus of claim 3, wherein said primary pulley is in the form of a stepped cone with multiple coaxial pulley grooves of graduated diameter for said auxiliary cable to select the distance of the vanishing point.

5. The apparatus of claim 3, wherein said cord is wrapped around said secondary pulley in the reverse manner to contact approximately 270° of the pulley and reverse the rotation thereof.

6. The apparatus of claim 1, further comprising a third idler pulley rotatably mounted to the drawing board below said other end of said rule and means for adjusting its position to determine the amount of slack in said auxiliary cable.

* * * * *